US010654276B2

(12) United States Patent
Enjo et al.

(10) Patent No.: US 10,654,276 B2
(45) Date of Patent: May 19, 2020

(54) INK-JET PRINTING DEVICE AND INK-JET PRINTING METHOD

(71) Applicant: SCREEN HOLDINGS CO., LTD., Kyoto-shi, Kyoto (JP)

(72) Inventors: Tatsuya Enjo, Kyoto (JP); Sachiko Takeuchi, Kyoto (JP); Satoru Kiyohara, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/045,710

(22) Filed: Jul. 25, 2018

(65) Prior Publication Data

US 2019/0030902 A1 Jan. 31, 2019

(30) Foreign Application Priority Data

Jul. 28, 2017 (JP) ..... 2017-146419

(51) Int. Cl.

| | |
|---|---|
| ***B41J 2/205*** | (2006.01) |
| ***B41J 2/17*** | (2006.01) |
| ***B41J 2/165*** | (2006.01) |
| ***B41J 2/045*** | (2006.01) |

(52) U.S. Cl.

CPC ..... *B41J 2/1707* (2013.01); *B41J 2/04501* (2013.01); *B41J 2/1652* (2013.01); *B41J 2/16526* (2013.01); *B41J 2002/16529* (2013.01)

(58) Field of Classification Search

USPC ..... 347/15, 14

See application file for complete search history.

(56) References Cited

U.S. PATENT DOCUMENTS

2008/0007585 A1* 1/2008 Ueda ..... B41J 2/16526 347/15

FOREIGN PATENT DOCUMENTS

JP 2007-290221 A 11/2007

* cited by examiner

*Primary Examiner* — Lam S Nguyen

(57) ABSTRACT

An ink-jet printing device according to the present invention includes at least one nozzle configured to discharge an ink droplet onto a recording medium conveyed in a conveyance direction, and a control unit to control flushing operation of the nozzle. Candidate regions are disposed at a plurality of places separated from each other in a conveyance direction of a cut sheet. The control unit controls the nozzle to perform the flushing operation in the candidate regions at a plurality of places in the conveyance direction of the cut sheet. With this configuration, the ink jet printing device can efficiently perform the flushing operation on a recording medium with reduced restriction on imposition.

9 Claims, 11 Drawing Sheets

INK-JET PRINTING DEVICE AND INK-JET PRINTING METHOD

BACKGROUND OF THE INVENTION

Field of the Invention

The present invention relates to an ink-jet printing device and an ink-jet printing method.

Description of the Background Art

In an ink-jet printing device, when a nozzle not in use for printing is left exposed to external air, ink near the nozzle dries, and ink discharge becomes unstable in some cases.

In a known technology (refer to Japanese Patent Application Laid-Open No. 2007-290221, for example) for solving this problem, flushing operation is performed in a region other than a region (complete region) on a recording medium onto which a printing image such as a character or an image is printed. The region other than the finishing region is a region (unnecessary region) trimmed and discarded when the recording medium after printing is fabricated into a print piece. The flushing operation is operation in which ink is discharged onto the unnecessary region.

Conventionally, in the unnecessary region of one cut sheet of a recording medium, the flushing operation has been performed in a margin region at the leading end or tail end of the cut sheet. However, when the margin region at the leading end or tail end does not have a sufficient width as a flushing region in which the flushing operation is performed, the flushing region extends out of the unnecessary region and partially overlaps the finishing region. To avoid overlapping of the flushing region on the finishing region, it has been needed to adjust disposition, in other words, imposition of the finishing region on one cut sheet.

Increase in the number of colors of ink used for ink jet printing leads to increase in the number of nozzles, and thus the necessary width of the flushing region is expected to further increase. Thus, it is important to efficiently perform flushing operation on a recording medium with reduced restriction on imposition.

SUMMARY OF THE INVENTION

The present invention is directed to an ink jet printing device.

An ink-jet printing device according to one aspect of the present invention includes at least one nozzle configured to discharge an ink droplet onto a recording medium conveyed in a conveyance direction, and a control unit to control flushing operation of the nozzle. Cutting positions at which cutting is performed are regularly disposed on the recording medium. A finishing region in which printing is performed and an unnecessary region other than the finishing region are disposed on a cut sheet extending between the cutting positions adjacent to each other on the recording medium. The unnecessary region includes a candidate region used to perform the flushing operation and having a width in a direction orthogonal to the conveyance direction. The candidate regions are disposed at a plurality of places separated from each other in the conveyance direction of the cut sheet. The control unit controls the nozzle to perform the flushing operation in the candidate regions at a plurality of places in the conveyance direction of the cut sheet.

With this configuration, the flushing operation is performed distributively across the candidate regions at the plurality of places separated from each other in the conveyance direction. Thus, a flushing region can be efficiently allocated when it is not possible to obtain a candidate region which is sufficiently large as a flashing region at one place. Accordingly, restriction on imposition can be reduced.

It is preferable that: a flushing width is defined to be a width of a flushing region in which the flushing operation is performed on the cut sheet, in the conveyance direction; a candidate width is defined to be a width of each candidate region in the conveyance direction; and the control unit controls the nozzle to perform the flushing operation in the candidate regions at a plurality of places, a sum of the candidate widths of which is equal to or larger than the flushing width.

With this configuration, the plurality of candidate regions at the plurality of places are set to be the flushing region so that the sum of the candidate widths of the candidate regions is equal to or larger than the flushing width. In other words, the flushing operation can be performed distributively across the plurality of places in the conveyance direction. Thus, when it is not possible to obtain at one place a candidate region which is sufficiently large as a flashing region, the flushing region can be efficiently allocated by setting a combination of the candidate regions at the plurality of places to be the flushing region.

It is preferable that: a plurality of the nozzles are arranged in the direction orthogonal to the conveyance direction; and the control unit controls the flushing operation by the plurality of the nozzles.

With this configuration, the control unit can control the flushing operation when the plurality of nozzles are arranged.

It is preferable that: the ink-jet printing device further includes a priority setting unit to set a priority to each candidate region; and the control unit sequentially sets, in descending order of the priority, each candidate region to be a flushing region in which the flushing operation is performed.

This configuration increases the freedom of setting the flushing region and allows setting of the flushing region in accordance with various usages.

It is preferable that: the candidate region includes a margin region between each cutting position and the finishing region in the conveyance direction, and a separation region between the finishing regions adjacent to each other in the conveyance direction; and the priority setting unit sets, to the separation region, a priority higher than a priority of the margin region.

With this configuration, overlapping of the flushing region with a positioning mark in the margin region can be effectively avoided by setting the priority of the separation region to be higher than the priority of the margin region.

It is preferable that the margin region is disposed separately from at least one of the cutting position and the finishing region, which, together with another finishing region adjacent in the conveyance direction, sandwiches the margin region.

With this configuration, the flushing region can be set in a range avoiding the positioning mark.

It is preferable that the separation region is disposed separately from at least one of the two finishing regions between which the separation region is sandwiched in the conveyance direction.

With this configuration, the flushing region can be set in a range not visually recognized when a product such as a book is produced by combining finishing regions each corresponding to a page.

The present invention is also directed to an ink-jet printing method.

An ink-jet printing method according to one aspect of the present invention controls flushing operation of at least one nozzle configured to discharge an ink droplet onto a recording medium conveyed in a conveyance direction. The method includes controlling the nozzle to perform the flushing operation in the candidate regions at a plurality of places in the conveyance direction of the cut sheet, when cutting positions at which cutting is performed are regularly disposed on the recording medium, a finishing region in which printing is performed and an unnecessary region other than the finishing region are disposed on a cut sheet extending range between the cutting positions adjacent to each other on the recording medium, the unnecessary region includes a candidate region used to perform the flushing operation and having a width in a direction orthogonal to the conveyance direction, and the candidate regions are disposed at a plurality of places separated from each other in the conveyance direction of the cut sheet.

With this configuration, the flushing operation is performed distributively across the candidate regions at the plurality of places separated from each other in the conveyance direction. Thus, a flushing region can be efficiently allocated when it is not possible to obtain at one place a candidate region which is sufficiently large as a flashing region. Accordingly, restriction on imposition can be reduced.

An ink jet printing method according to one aspect of the present invention uses at least one nozzle configured to discharge ink toward a recording medium conveyed in a conveyance direction in accordance with printing data. The method includes: setting a flushing pattern for the cut sheet, when cutting positions at which cutting is performed are regularly disposed on the recording medium, and a cut sheet extending between cutting positions adjacent to each other is defined on the recording medium; specifying a flushing width as a length of the set flushing pattern in the conveyance direction; extracting, by referring to the printing data, a plurality of candidate regions in which flushing is to be executed on the cut sheet; specifying a candidate width as a length of each extracted candidate region in the conveyance direction; dividing, by referring to the flushing width and the plurality of candidate widths, the flushing pattern to produce divided flushing patterns each having a length equal to or smaller than the candidate widths of the plurality of candidate regions in the conveyance direction; adding data for printing the plurality of divided flushing patterns to the printing data so that the divided flushing patterns are printed in the corresponding candidate regions; and executing the flushing operation while executing printing based on the printing data to which the data for printing the divided flushing patterns is added by discharging the ink from the nozzle toward the recording medium being conveyed in the conveyance direction in accordance with the printing data.

With this configuration, the flushing operation is performed distributively across the candidate regions at a plurality of places separated from each other in the conveyance direction. Thus, a flushing region can be efficiently allocated when it is not possible to obtain at one place a candidate region which is sufficiently large as a flashing region.

Accordingly, restriction on imposition can be reduced.

The present invention is intended to provide an ink-jet printing device capable of efficiently performing flushing operation on a recording medium with reduced restriction on imposition.

These and other objects, features, aspects and advantages of the present invention will become more apparent from the following detailed description of the present invention when taken in conjunction with the accompanying drawings.

DESCRIPTION OF THE PREFERRED EMBODIMENTS

A preferred embodiment of the present invention will be described below with reference to the accompanying drawings.

The drawings are schematically illustrated with omission or simplification of any component as appropriate for convenience of description. Mutual relations in size and position between components or the like illustrated in different drawings are not necessarily accurately illustrated but may be changed as appropriate.

In the following description, any identical component is denoted by an identical reference sign, and the name and function thereof are identical as well. Thus, any detailed description thereof will be omitted in some cases to avoid duplication.

In the following description, when terms such as "up", "down", "left", "right", "side", "bottom", "top", and "back" are used to mean particular positions and directions, these terms are used for sake of convenience to facilitate understanding of the contents of the preferred embodiment, and are not related to any direction when the invention is actually achieved.

Preferred Embodiment

The following describes an ink-jet printing device, an ink-jet printing method, and an ink-jet printing system according to the present preferred embodiment.

<Configuration of Ink-Jet Printing System>

Figure 1:
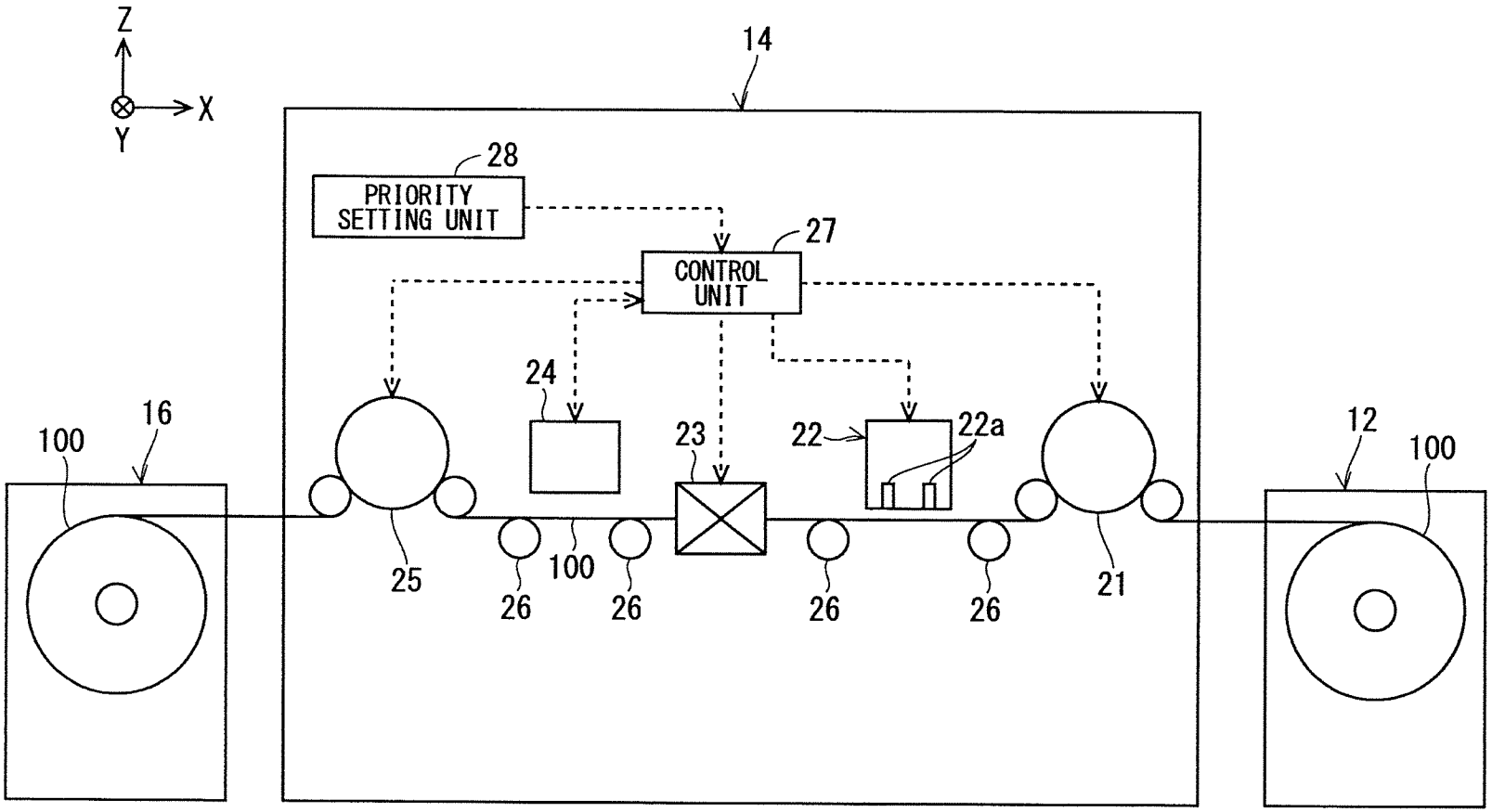
FIG. 1 is a diagram schematically and exemplarily illustrating the configuration of an ink-jet printing system according to a preferred embodiment.

FIG. 1 is a diagram schematically and exemplarily illustrating the configuration of the ink jet printing system according to the present preferred embodiment. As exemplarily illustrated in FIG. 1, the ink-jet printing system according to the present preferred embodiment includes a feed unit 12, an ink-jet printing device 14, and a sheet discharge unit 16.

The feed unit 12 holds rolled continuous form paper 100 rotatably about a horizontal axis, and supplies the continuous form paper 100 to the ink-jet printing device 14 by unwinding it. The ink-jet printing device 14 performs printing on the continuous form paper 100. The sheet discharge unit 16 winds, about the horizontal axis, the continuous form paper 100 printed at the ink-jet printing device 14.

When a side from which the continuous form paper 100 is supplied is defined to be upstream, and a side from which the continuous form paper 100 is discharged is defined to be downstream, the feed unit 12 is disposed upstream of the ink-jet printing device 14, and the sheet discharge unit 16 is disposed downstream of the ink-jet printing device 14.

The ink jet printing device 14 includes, sequentially from the upstream side from which the continuous form paper is supplied, a drive roller 21, an ink-jet head 22, a drying unit 23, an examination unit 24, and a drive roller 25. The ink-jet printing device 14 includes, between these components, a plurality of conveyance rollers 26 supporting the continuous form paper 100 being conveyed.

The drive roller 21 acquires the continuous form paper 100 from the feed unit 12. The continuous form paper 100 being unwound from the feed unit 12 by the drive roller 21 is conveyed toward the sheet discharge unit 16 on the downstream side along the plurality of conveyance rollers 26, in other words, a negative X-axis direction in FIG. 1.

The drive roller 25 sends, toward the sheet discharge unit 16, the continuous form paper 100 being conveyed along the conveyance rollers 26.

The drying unit 23 dries ink printed by the ink jet head 22. The examination unit 24 examines any contamination, printing miss, or the like in a printed region.

The ink-jet head 22 includes a plurality of nozzles 22*a* configured to discharge ink droplets. The configuration of the ink jet head 22 will be described later in detail.

The ink-jet printing device 14 includes a control unit 27 and a priority setting unit 28. The control unit 27 and the priority setting unit 28 are each achieved by a computer including, for example, a mouse, a keyboard, a monitor, and an external data inputting instrument, and specifically each correspond to a CPU and a transitory or non-transitory memory.

The control unit 27 controls printing operation on the continuous form paper 100 controlling operation of the drive roller 21, the ink jet head 22, the drying unit 23, the examination unit 24, and the drive roller 25 based on input printing data. The priority setting unit 28 sets a priority to a candidate region, which is described later, based on the input printing data.

Figure 2:
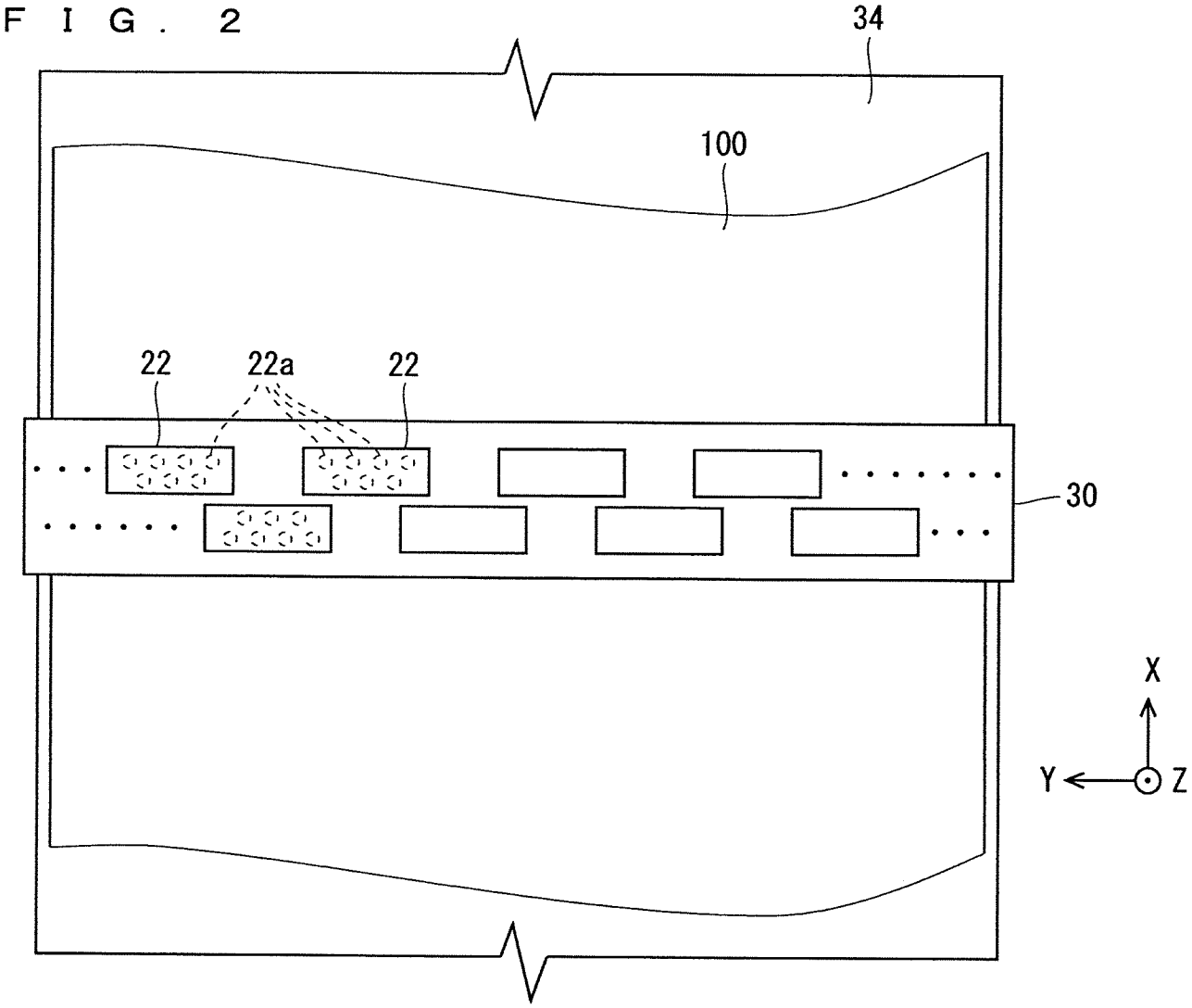
FIG. 2 is a plan view exemplarily illustrating the configuration of a line head including a plurality of ink jet heads and the vicinity thereof according to the preferred embodiment.

FIG. 2 is a plan view exemplarily illustrating the configuration of a line head including a plurality of ink-jet heads and the vicinity thereof. In FIG. 2, a conveyance direction of the continuous form paper 100 is in the negative X-axis direction, and a printing direction is in a positive X-axis direction, which is opposite to the conveyance direction. As exemplarily illustrated in FIG. 2, this line head 30 includes an array of a plurality of ink-jet heads 22 each including the plurality of nozzles 22*a*. In the case exemplarily illustrated in FIG. 2, the ink jet heads 22 are disposed in a zigzag manner at the line head 30, but are not limited to the disposition disclosed in FIG. 2.

Typically, a plurality of line heads 30 are disposed in the conveyance direction (negative X-axis direction) of the continuous form paper 100. For example, one or two line heads 30 may be provided for each of black (K), cyan (C), magenta (M), and yellow (Y). However, to facilitate understanding of the invention, only one ink-jet head 22 is illustrated in FIG. 1, and only one line head 30 is illustrated in FIG. 2.

As exemplarily illustrated in FIG. 2, each ink-jet head 22, and hence the line head 30 including the plurality of ink-jet heads 22 are disposed in a posture with a longitudinal direction thereof being aligned with a direction orthogonal to the conveyance direction of the continuous form paper 100, in other words, a Y-axis direction in FIG. 2. The line head 30 has a length equal to or longer than the width of a conveyance path 34 on which the continuous form paper 100 is conveyed, preferably, a length equal to the width of the conveyance path 34.

Figure 3:
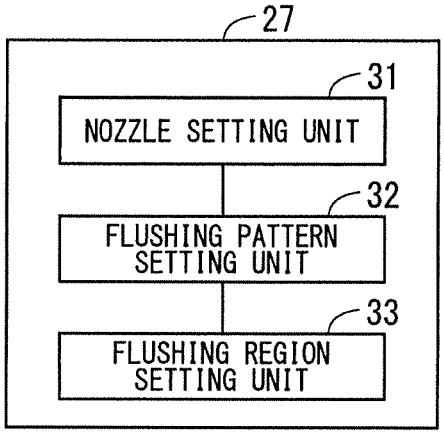
FIG. 3 is a diagram conceptually and exemplarily illustrating a functional configuration of a control unit exemplarily illustrated in FIG. 1.

FIG. 3 is a diagram conceptually and exemplarily illustrating a functional configuration of the control unit exemplarily illustrated in FIG. 1. As exemplarily illustrated in FIG. 3, the control unit 27 includes a nozzle setting unit 31, a flushing pattern setting unit 32, and a flushing region setting unit 33.

The nozzle setting unit 31 converts input printing data to data in, for example, a raster format. Then, the nozzle setting unit 31 allocates any one of the nozzles 22*a* from which an ink droplet is to be discharged to each dot in the printing data in the raster format.

The flushing pattern setting unit 32 sets a flushing pattern based on specifications of the continuous form paper 100, such as the sheet width, the sheet thickness, and the sheet length as well as the printing data described above. The flushing pattern is a discharge pattern of ink droplets when flushing operation is performed. The flushing operation is operation in which ink is discharged toward an unnecessary region other than a finishing region on each cut sheet.

Figure 4:
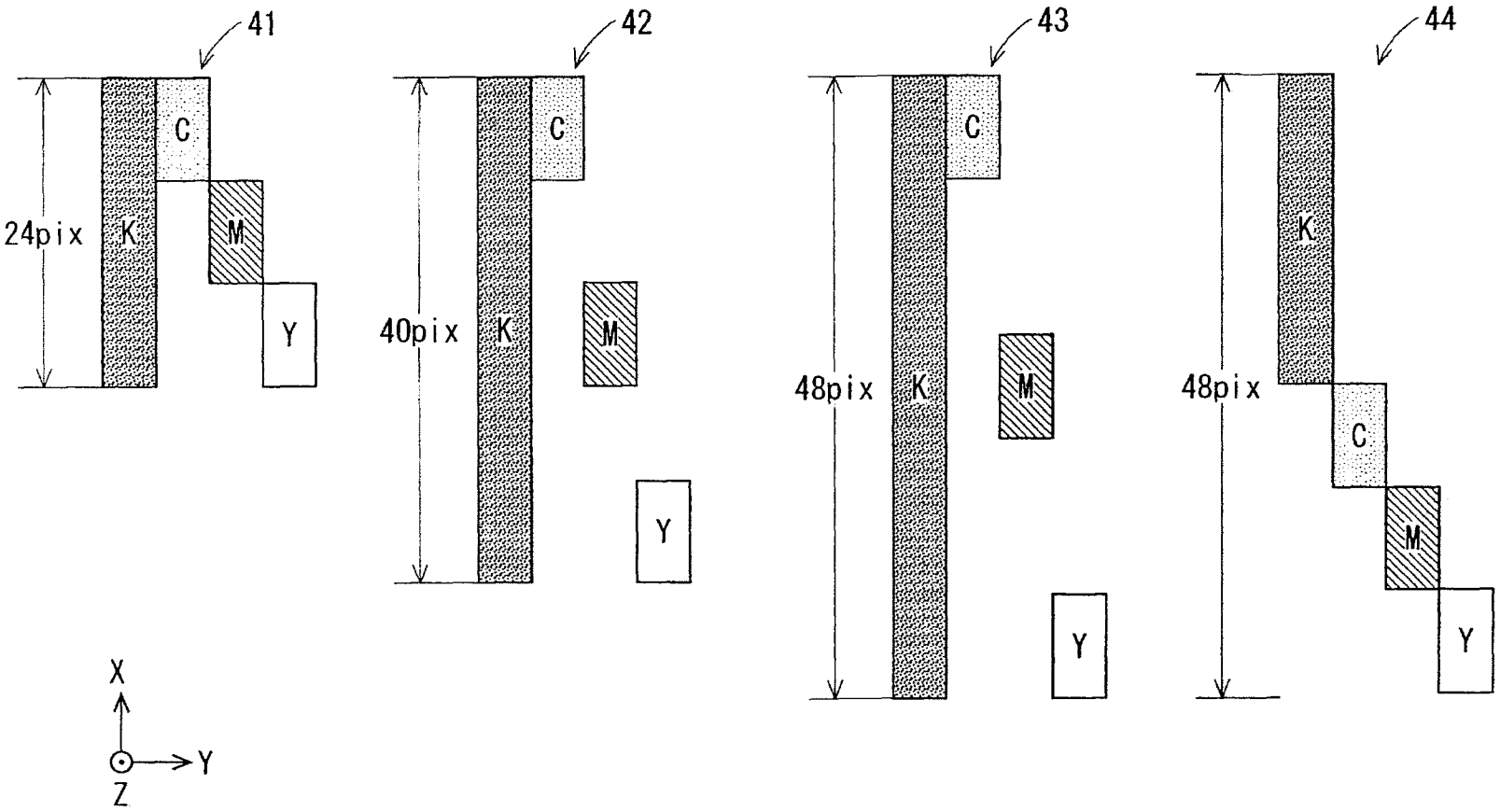
FIG. 4 is a diagram exemplarily illustrating a plurality of flushing patterns according to the preferred embodiment.

FIG. 4 is a diagram exemplarily illustrating a plurality of flushing patterns. In FIG. 4, the conveyance direction of the continuous form paper 100 is in the negative X-axis direction. The flushing patterns exemplarily illustrated in FIG. 4 include a pattern in which black (K), cyan (C), magenta (M), and yellow (Y) are discharged in an overlapping manner in a Z-axis direction, but the overlapping order of ink in different colors is not limited to that exemplarily illustrated in FIG. 4.

FIG. 4 exemplarily illustrates a flushing pattern 41, a flushing pattern 42, a flushing pattern 43, and a flushing pattern 44. The width of each flushing pattern in the X-axis direction is a total width in the conveyance direction, which is needed to form the flushing pattern on one cut sheet, and is referred to as a flushing width in the following description. A cut sheet is defined to extend between cutting positions adjacent to each other on the continuous form paper 100. Each cutting position is a position at which the continuous form paper 100 is to be regularly cut in postprocessing. Cut sheets typically have identical lengths in the X-axis direction, but do not necessarily have identical lengths.

The flushing pattern 41 has a flushing width of 24 pixels, the flushing pattern 42 has a flushing width of 40 pixels, the flushing pattern 43 has a flushing width of 48 pixels, and the flushing pattern 44 has a flushing width of 48 pixels.

In printing of the flushing pattern 41, a K color pattern overlaps a Y color pattern, overlaps an M color pattern, and overlaps a C color pattern. The K color pattern in the flushing pattern 41 is a pattern having a width of 24 pixels in the X-axis direction and elongated in the Y axis direction. The C color pattern, the M color pattern, and the Y color pattern are each a pattern having a width of 8 pixels in the X-axis direction and elongated in the Y axis direction. The length of each color pattern in the Y axis direction is determined based on the position of the nozzle 22*a* for which the flushing operation needs to be performed. For example, when the plurality of nozzles 22*a* for which the flushing operation needs to be performed are disposed across the entire length of the continuous form paper 100 in the Y axis direction, the length of each color pattern in the Y axis direction is equal to the length of the continuous form paper 100 in the Y axis direction.

Similarly to the flushing pattern 41, the flushing pattern 42 is a pattern in which a K color pattern overlaps a Y color pattern, overlaps an M color pattern, and overlaps the C color pattern. The K color pattern in the flushing pattern 41 is a pattern having a width of 40 pixels in the X-axis direction and elongated in the Y axis direction. The C color pattern, the M color pattern, and the Y color pattern are each a pattern having a width of 8 pixels in the X-axis direction and elongated in the Y axis direction. Although the C color pattern and the M color pattern are separated from each other in the X-axis direction in FIG. 4, the size of the interval between the C color pattern and the M color pattern in the X-axis direction is freely set. The C color pattern and the M color pattern may contact with each other in the X-axis direction. Similarly, the size of the interval between the M color pattern and the Y color pattern in the X-axis direction is freely set. The M color pattern and the Y color pattern may contact with each other in the X-axis direction.

The flushing pattern 43 is different from the flushing pattern 42 in that the length of the K color pattern in the X-axis direction is not equal to 40 pixels but equal to 48 pixels.

The flushing pattern 44 includes a K color pattern, a C color pattern, an M color pattern, and a Y color pattern. The color patterns of the flushing pattern 44 are not printed in an overlapping manner. The K color pattern is a pattern having a width of 40 pixels in the X-axis direction and elongated in the Y axis direction. The C color pattern, the M color pattern, and the Y color pattern are each a pattern having a width of 8 pixels in the X-axis direction and elongated in the Y axis direction.

The C color pattern, the M color pattern, and the Y color pattern are arrayed in this order from the positive X-axis direction in the flushing patterns 41 to 44, but may be arrayed in any other different order for printing. For example, flushing may be performed through printing in the order of the M color pattern, the C color pattern, and the Y color pattern.

In FIG. 4, the C, M, Y, and K color patterns are shifted from each other in the X axis direction, but may be formed at an identical position in the X axis direction in an actual flushing pattern.

As exemplarily illustrated in FIG. 4, different flushing patterns are formed depending on the shape of nozzle arrangement, a recording medium onto which ink droplets are discharged, the material (for example, pigment or dye) of discharged ink droplets, and the conveyance speed of the recording medium. Different flushing patterns are also formed depending on the length of a non-ink-discharge period in which no ink droplets are discharged from the nozzles 22*a*, and an ink characteristic such as viscosity.

For example, when ink is made of fast drying material, a time sufficient for allowing ink to dry can be obtained at overlapping discharge of ink in a plurality of colors, and thus the flushing width can be reduced by discharging ink in the plurality of colors in identical regions as in the flushing pattern 41, the flushing pattern 42, and the flushing pattern 43. However, when ink is made of slow drying material, the recording medium reaches the downstream side on the conveyance path 34 while the ink is not sufficiently dried, and for example, the ink adheres to the conveyance rollers 26. Thus, the flushing width is relatively large as in the flushing pattern 44.

At a fast conveyance speed, ink droplets are discharged at short time intervals, and thus the flushing width is reduced. However, at a slow conveyance speed, the nozzles are exposed to external air for a long time, and thus the flushing width is relatively large. When the number of ink types increases as the number of colors increases, the number of line heads 30 disposed in the conveyance direction increases, and thus a longer flushing width is needed typically.

When an image for which the non-ink-discharge period is long is printed or when ink having a relatively high viscosity is used, a flushing pattern having a relatively large flushing width is set so that nozzle clog is reliably prevented by discharging a large amount of ink through the nozzles 22*a*.

The flushing pattern setting unit 32 illustrated in FIG. 3 sets a flushing pattern with taken into account the above-described point. Failure such as discharge defect of the nozzles 22*a* can be reliably prevented by printing the flushing pattern onto one cut sheet at a predetermined frequency. In addition, the flushing width of the set flushing pattern is specified.

In the control unit 27 illustrated in FIG. 3, the flushing region setting unit 33 first extracts a candidate region for a flushing region from the unnecessary region on a cut sheet by referring to printing data. The flushing region is a region in which the flushing operation is performed on the cut sheet. The width of the flushing region in the conveyance direction corresponds to the flushing width. When the flushing operation is performed over a plurality of candidate regions separated from each other, the aggregation of these candidate regions is described as a flushing region.

A candidate region is the unnecessary region, the width of which in the direction orthogonal to the conveyance direction is equal to or larger than a width in the orthogonal direction necessary for performing the flushing operation. In the present preferred embodiment, the line head 30 is disposed over both ends of the continuous form paper 100 in the Y-axis direction, and thus the flushing operation is a line flushing operation performed in a linear region in the direction orthogonal to the conveyance direction over both ends of the continuous form paper 100 in the Y-axis direction. Accordingly, the candidate region extracted by the flushing region setting unit 33 in the present preferred embodiment is a linear region in the direction orthogonal to the conveyance direction, in other words, a region, the width of which in the direction (Y-axis direction) orthogonal to the conveyance direction is equal to the width of the continuous form paper 100 in the Y-axis direction.

Figure 5:
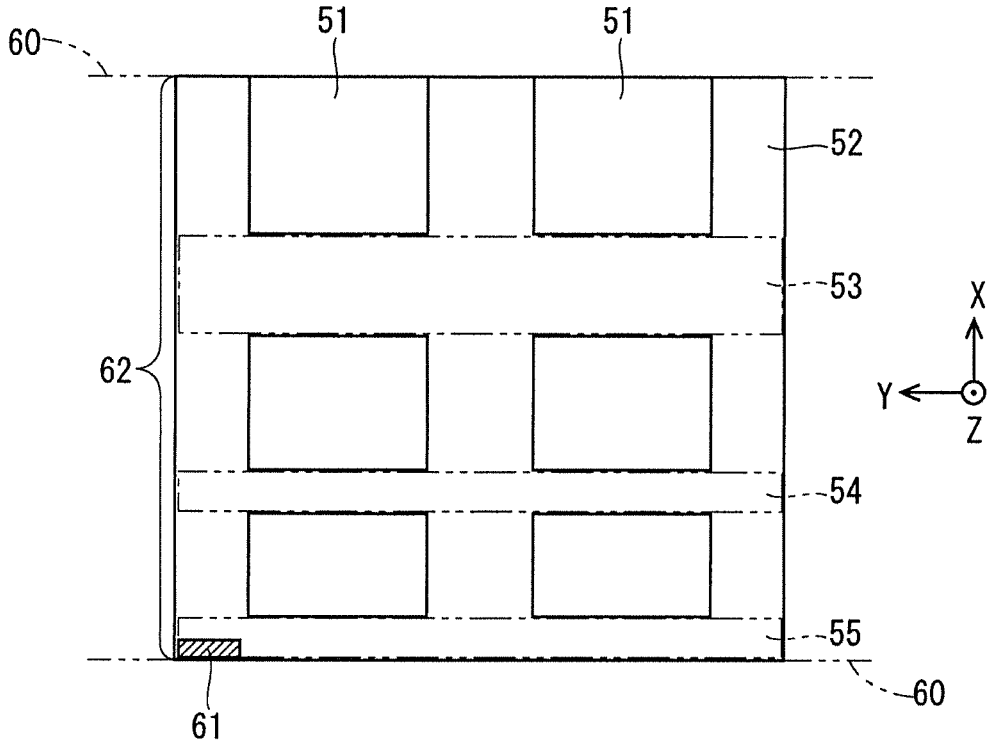
FIG. 5 is a diagram exemplarily illustrating finishing regions and an unnecessary region in printing data according to the preferred embodiment.

FIG. 5 is a diagram exemplarily illustrating finishing regions and an unnecessary region in printing data. Printing data exemplarily illustrated in FIG. 5 has a length equal to the length of a unit between cutting positions at which the continuous form paper 100 is cut, and the unit corresponds to one cut sheet 62. Each finishing region is a region in which, for example, an image or a character is printed in printing data, and the unnecessary region is a region other than the finishing region and is a region in which, for example, no image nor character is printed and that is cut and discarded after printing. The flushing operation is performed in the unnecessary region, and thus, the flushing region is disposed in the unnecessary region, specifically, a candidate region in the unnecessary region.

As illustrated in FIG. 5, for example, finishing regions 51 corresponding to six pages are disposed on one cut sheet. In the case exemplarily illustrated in FIG. 5, an unnecessary region 52 is disposed around the finishing regions 51.

A margin region 55 is a region between a cutting position 60 and the finishing regions 51 in the conveyance direction in the unnecessary region 52. A separation region 53 and a separation region 54 are each a region between the finishing regions 51 adjacent to each other in the conveyance direction. The margin region is not limited to a white region.

The flushing region setting unit 33 illustrated in FIG. 3 extracts, for example, the margin region 55, the separation region 53, and the separation region 54 in FIG. 5 as candidate regions for the flushing region. This is because the flushing operation in the present preferred embodiment is a line flushing operation, and the margin region 55, the separation region 53, and the separation region 54 are unnecessary regions having a width equal to or larger than a width (the entire width of the continuous form paper in the Y-axis direction) in the Y-axis direction, which is necessary for performing the flushing operation. The margin region 55, the separation region 53, and the separation region 54 are disposed separately from one another.

Then, the flushing region setting unit 33 sets the flushing region by comparing the flushing width of the flushing pattern, which is specified by the flushing pattern setting unit 32, with the sum of candidate widths that are the widths of the margin region 55, the separation region 53, and the separation region 54 extracted as described above in the conveyance direction. This operation will be described later in detail.

The priority setting unit 28 illustrated in FIG. 1 sets a priority to each candidate region based on input printing data. The set priority is output to the control unit 27.

In the case exemplarily illustrated in FIG. 5, the priority setting unit 28 sets a priority to each of the margin region 55, the separation region 53, and the separation region 54, and defines an order in which the regions are to be each set as the flushing region.

The priority setting is performed, for example, so that the priority of any separation region is higher than the priority of a margin region. This is because a positioning mark 61 used in positioning of the front and back surfaces is disposed in the margin region in some cases, and overlapping of the flushing region on the positioning mark potentially causes failure in positioning of the continuous form paper 100. Alternatively, the priority setting may be performed in accordance with, for example, the size of a candidate width and the position of the candidate region in the conveyance direction.

<Operation of Ink-Jet Printing System>

Figure 6:
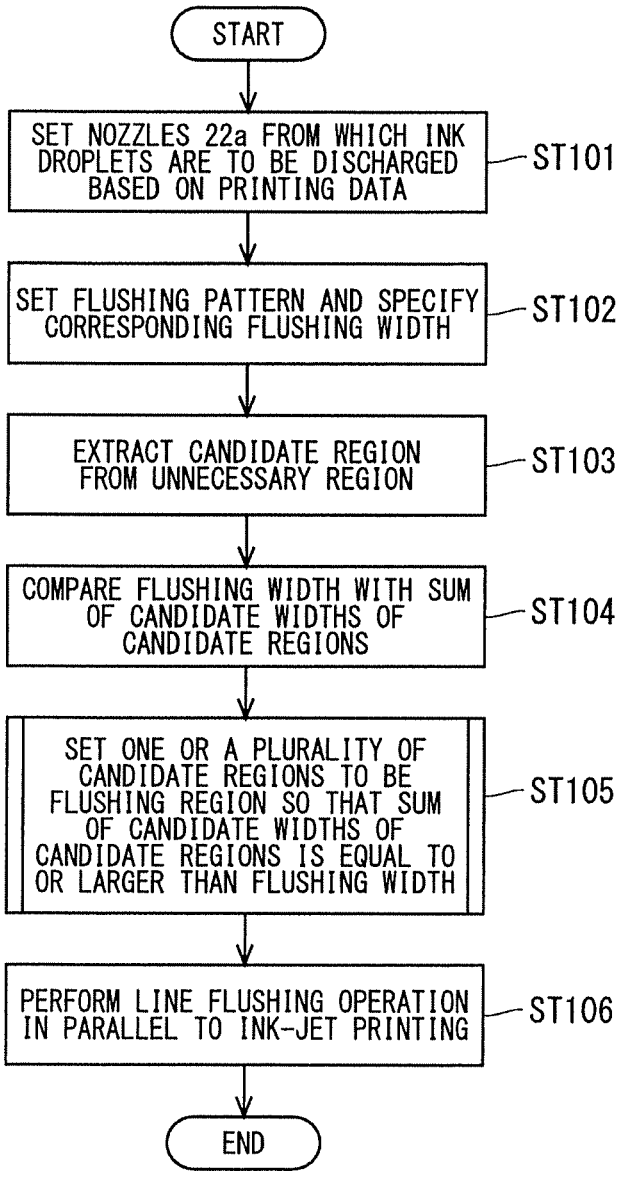
FIG. 6 is a flowchart illustrating operation of the ink-jet printing system according to the preferred embodiment.

The following describes operation of the ink-jet printing system according to the present preferred embodiment with reference to FIGS. 6 to 11. FIG. 6 is a flowchart illustrating the operation of the ink-jet printing system.

First, the nozzle setting unit 31 of the control unit 27 sets the nozzles 22*a* from which ink droplets are to be discharged based on printing data input by an operator (step ST101 in FIG. 6).

Subsequently, the flushing pattern setting unit 32 of the control unit 27 sets the flushing pattern based on the specifications of the continuous form paper 100 and the printing data, and further specifies the corresponding flushing width (step ST102 in FIG. 6).

Subsequently, the flushing region setting unit 33 of the control unit 27 extracts any candidate region for the flushing region from the unnecessary region 52 of the printing data. In the present preferred embodiment, the flushing region setting unit 33 extracts, as candidate regions, one or a plurality of regions across the entire width of the continuous form paper 100 in the Y-axis direction corresponding to the line flushing operation (step ST103 in FIG. 6). In the present example, the flushing region setting unit 33 can extract, from the cut sheet 62, the separation region 53, the separation region 54, and the margin region 55 as a plurality of candidate regions in which flushing can be executed.

Subsequently, the flushing region setting unit 33 compares the flushing width specified by the flushing pattern setting unit 32 with the sum of the candidate widths of the candidate regions (step ST104 in FIG. 6). The sum of the candidate widths of the candidate regions is the candidate width of a single candidate region when only the candidate region is available.

Subsequently, the flushing region setting unit 33 sets one or a plurality of candidate regions to be the flushing region so that the sum of the candidate widths of the candidate regions is equal to or larger than the flushing width (step ST105 in FIG. 6).

Subsequently, the control unit 27 controls printing operation on the continuous form paper 100, which includes the flushing operation, by controlling operation of the ink jet head 22 of the line head 30 as well as operation of the drive roller 21, the drying unit 23, the examination unit 24, and the drive roller 25 based on printing data for which the flushing region is set, in other words, printing data to which data for printing the flushing pattern is added.

When the control unit 27 operates in this manner, the ink jet head 22 in the ink-jet printing system performs ink jet printing by discharging ink droplets from the nozzles 22*a* based on the printing data, and performs, in parallel to the ink jet printing, the line flushing operation in which ink droplets are discharged from the ink-jet head 22 (step ST106 in FIG. 6).

<Details of Step ST105>

Figure 7:
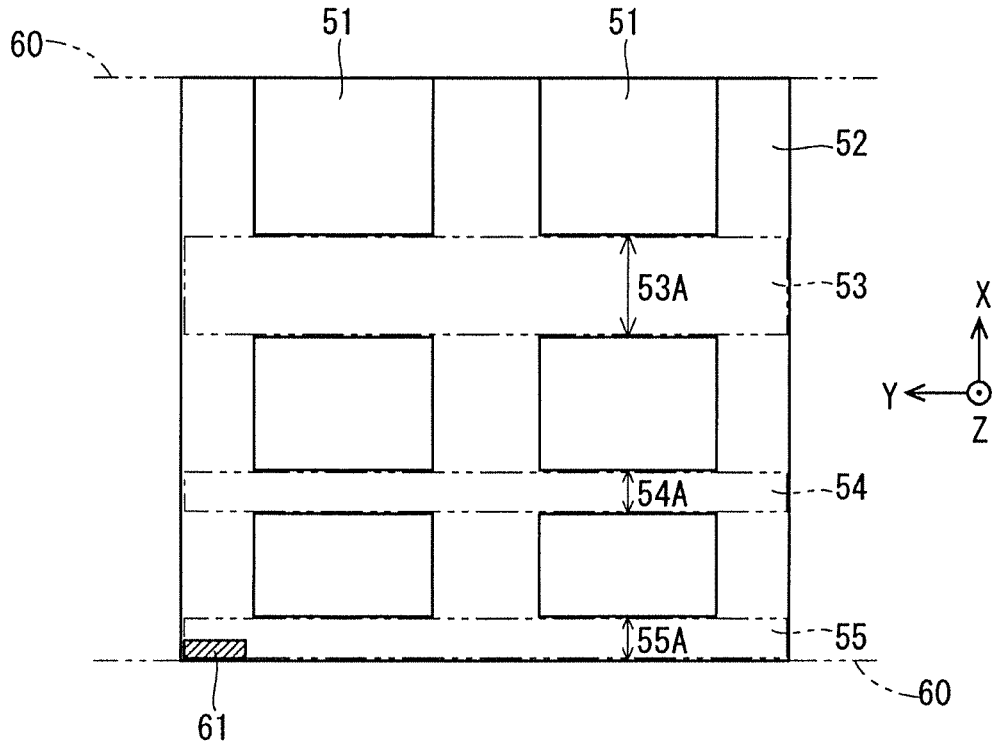
FIG. 7 is a diagram exemplarily illustrating a candidate region in printing data according to the preferred embodiment.
Figure 8:
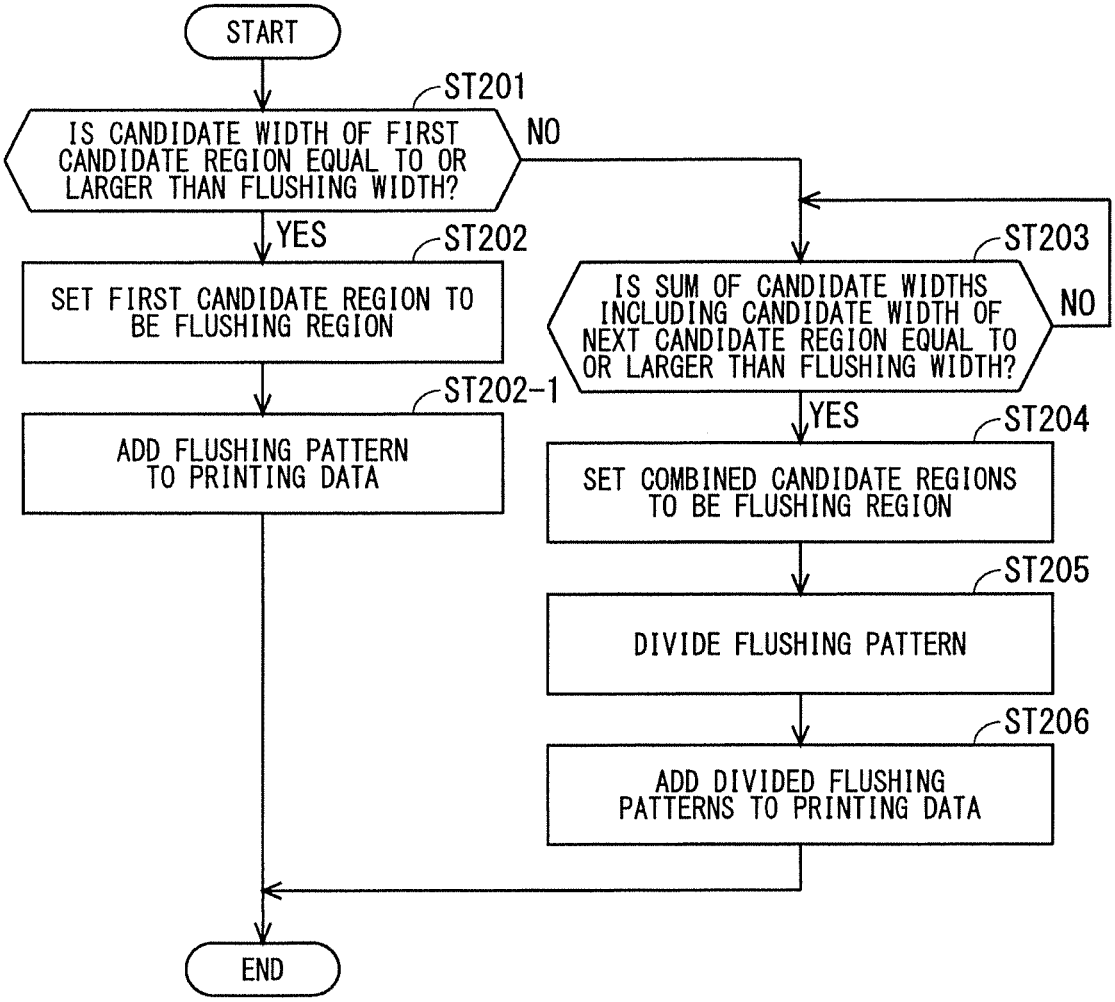
FIG. 8 is a flowchart for detailed description of operation at step ST105 according to the preferred embodiment.

The following describes the operation at step ST105 further in detail with reference to FIGS. 7 and 8. FIG. 7 is a diagram exemplarily illustrating a candidate region in printing data. FIG. 8 is a flowchart for detailed description of the operation at step ST105.

At step ST105, the flushing region setting unit 33 first determines whether the candidate width of a first candidate region based on a selection order determined in advance is equal to or larger than the flushing width (step ST201 in FIG. 8). The "selection order determined in advance" is a selection order in which a plurality of candidate regions are each set to be the flushing region, and in this example, a candidate region positioned further upstream in the printing direction (lower side in FIG. 7) is sequentially set to be the flushing region. Accordingly, in FIG. 7, the first candidate region is the margin region 55.

When the margin region 55 has a candidate width 55A equal to or larger than the flushing width, the flushing region setting unit 33 sets the margin region 55 to be the flushing region and ends the operation (step ST202 in FIG. 8).

Subsequently, data for printing the flushing pattern is added to printing data of the cut sheet 62 so that the flushing pattern is printed in the flushing region (candidate region) set at step ST202 (step ST202-1 in FIG. 8).

When the candidate width 55A of the margin region 55 is not equal to nor larger than the flushing width, the flushing region setting unit 33 determines whether the sum of candidate widths including the candidate width of the next candidate region is equal to or larger than the flushing width (step ST203 in FIG. 8). In this example, the flushing region setting unit 33 determines whether the sum of the candidate width 55A of the margin region 55 and a candidate width 54A of the separation region 54 is equal to or larger than the flushing width.

When the sum of candidate widths, specifically, the sum of the candidate width 55A and the candidate width 54A is equal to or larger than the flushing width, the flushing region setting unit 33 sets a combined candidate region of the margin region 55 and the separation region 54 to be the flushing region and ends the operation (step ST204 in FIG. 8).

Subsequently, the flushing region setting unit 33 divides, into a plurality of divided flushing patterns, the flushing pattern to be printed on the one cut sheet in accordance with the lengths of the margin region 55 and the separation region 54 set to be the flushing region in the X-axis direction (step ST205 in FIG. 8).

Subsequently, the flushing region setting unit 33 adds, to the printing data, data for printing each divided flushing pattern so that the divided flushing patterns are printed in the corresponding candidate regions (the margin region 55 and the separation region 54) (step ST206 in FIG. 8).

When it is determined at step ST203 that the sum of candidate widths is not equal to nor larger than the flushing width, the flushing region setting unit 33 determines whether the sum of candidate widths including the candidate width of the next candidate region is equal to or larger than the flushing width (the operation returns to step ST203 in FIG. 8). In this example, the flushing region setting unit 33 determines whether the sum of the candidate width 55A, the candidate width 54A, and a candidate width 53A of the separation region 53 is equal to or larger than the flushing width.

In this manner, when the candidate width of one candidate region is not equal to nor larger than the flushing width, the flushing region can be efficiently allocated on a cut sheet by setting a combination of a plurality of candidate regions to be the flushing region. Accordingly, restriction on imposition can be reduced. The reduction of restriction on imposition leads to reduction of waste paper.

Figure 9A:
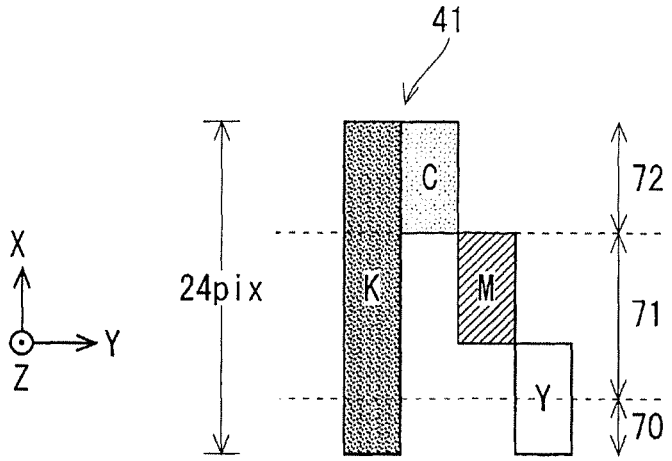
FIGS. 9A and 9B are each a diagram exemplarily illustrating a division pattern when flushing operation is performed in a divided manner according to the preferred embodiment.

In the operation at step ST105 described above, when the flushing operation is performed across a plurality of candidate regions, a flushing pattern may be divided as illustrated in FIG. 9A. Specifically, the flushing operation is performed sequentially in a candidate region positioned upstream in the printing direction. The flushing operation is temporary interrupted when performed in an amount corresponding to the candidate width of the candidate region, and then the remaining amount of the flushing operation is performed in a candidate region positioned downstream of the previous candidate region in the printing direction. FIG. 9A illustrates an example in which the flushing pattern 41 described above with reference to FIG. 4 is divided into three divided flushing patterns.

In a first division pattern 70, the K color pattern having a width of 4 pixels in the X-axis direction and the Y color pattern having a width of 4 pixels in the same direction are printed in an overlapping manner.

In a second division pattern 71, the K color pattern having a width of 4 pixels in the X-axis direction and the Y color pattern having a width of 4 pixels in the same direction are printed in an overlapping manner, the K color pattern having a width of 8 pixels in the same direction and the M color pattern having a width of 8 pixels in the same direction are printed in an overlapping manner.

In a third division pattern 72, the K color pattern having a width of 8 pixels in the X-axis direction and the C color pattern having a width of 8 pixels in the same direction are printed in an overlapping manner.

As exemplarily illustrated in FIG. 9A, each of the boundary between the first division pattern 70 and the second division pattern 71 and the boundary between the second division pattern 71 and the third division pattern 72 may coincide with the timing of switching discharged ink like the boundary between the second division pattern 71 and the third division pattern 72, or does not need to coincide with the timing of switching discharged ink like the boundary between the first division pattern 70 and the second division pattern 71. The position of the boundary of the first division pattern 70 or the position of the boundary of the third division pattern 72 may be changed as appropriate as long as the length of the first division pattern 70 and the length of the third division pattern 72 in the X-axis direction are equal to or smaller than the length of a candidate region in the X-axis direction.

Figure 9B:
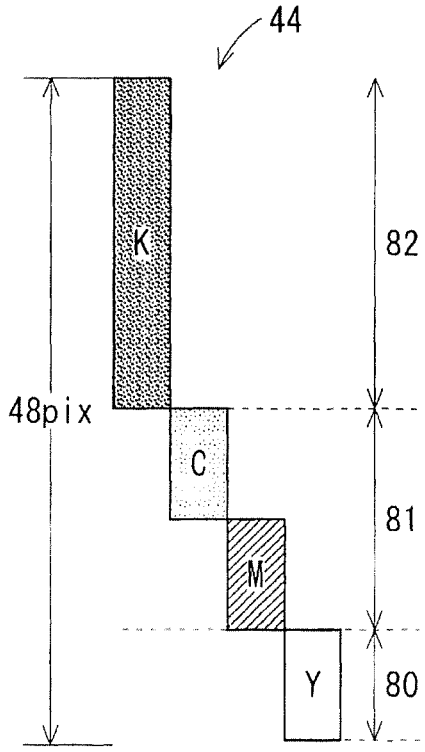

A flushing pattern may be divided as illustrated in FIG. 9B. FIG. 9B illustrates an example in which the flushing pattern 44 described above with reference to FIG. 4 is divided into three divided flushing patterns. Specifically, a first division pattern 80 is made of a Y color pattern. A second division pattern 81 is made of a C color pattern and an M color pattern not overlapping each other. A third division pattern 82 is made of a K color pattern.

Figure 10:
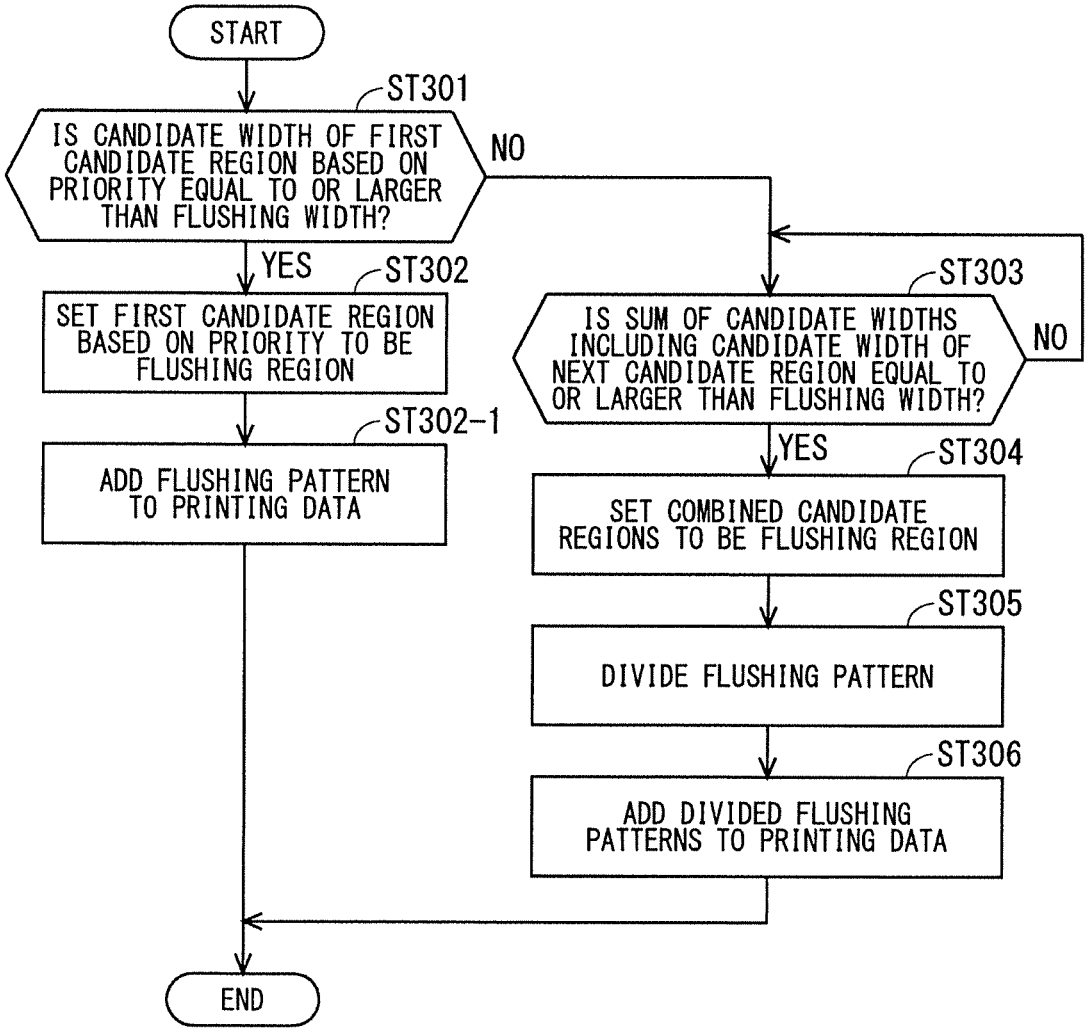
FIG. 10 is a flowchart for detailed description of the operation at step ST105 according to the preferred embodiment.

With reference to FIGS. 7 and 10, the following describes further in detail the operation at step ST105 for a case in which a priority is set to each candidate region in advance. FIG. 10 is a flowchart for detailed description of the operation at step ST105.

At step ST105, the flushing region setting unit 33 first determines whether the candidate width of a first candidate region based on a priority set in advance by the priority setting unit 28 illustrated in FIG. 1 is equal to or larger than the flushing width (step ST301 in FIG. 10). The priority setting unit 28 sets the priority of a separation region to be higher than the priority of a margin region. Among the candidate regions illustrated in FIG. 7, the separation region 54 has a highest priority, and the margin region 55 has a lowest priority.

When the candidate width 54A of the separation region 54 is equal to or larger than the flushing width, the flushing region setting unit 33 sets the separation region 54 to be the flushing region, and ends the operation (step ST302 in FIG. 10).

Subsequently, data for printing the flushing pattern is added to printing data of the cut sheet 62 so that the flushing pattern is printed in the flushing region (candidate region) set at step ST302 (step ST302-1 in FIG. 10).

When the candidate width 54A of the separation region 54 is not equal to nor larger than the flushing width, the flushing region setting unit 33 determines whether the sum of candidate widths including the candidate width of the next candidate region is equal to or larger than the flushing width (step ST303 in FIG. 10). In this example, the flushing region setting unit 33 determines whether the sum of the candidate width 54A of the separation region 54 and the candidate width 53A of the separation region 53 is equal to or larger than the flushing width.

When the sum of candidate widths, specifically, the sum of the candidate width 54A and the candidate width 53A is equal to or larger than the flushing width, the flushing region setting unit 33 sets a combined candidate region of the separation region 54 and the separation region 53 to be the flushing region, and ends the operation (step ST304 in FIG. 10).

Subsequently, the flushing region setting unit 33 divides the flushing pattern to be printed on one cut sheet into a plurality of flushing patterns in accordance with the lengths of the margin region 55 and the separation region 54 set to be the flushing region in the X-axis direction (step ST305 in FIG. 10).

Subsequently, the flushing region setting unit 33 adds each divided flushing pattern to printing data so that the divided flushing patterns are printed in the margin region 55 and the separation region 54 set to be the flushing region (step ST306 in FIG. 10).

When it is determined at step ST303 that the sum of candidate widths is not equal to nor larger than the flushing width, the flushing region setting unit 33 determines whether the sum of candidate widths including the candidate width of the next candidate region is equal to or larger than the flushing width (the operation returns to step ST303 in FIG. 10). In this example, the flushing region setting unit 33 determines whether the sum of the candidate width 54A, the candidate width 53A, and the candidate width 55A of the margin region 55 is equal to or larger than the flushing width.

In this manner, when the candidate width of one candidate region is not equal to nor larger than the flushing width, the flushing region can be efficiently allocated on a cut sheet by setting a combination of a plurality of candidate regions to be the flushing region. Accordingly, restriction on imposition can be reduced. The reduction of restriction on imposition leads to reduction of waste paper.

In FIG. 7, the separation region 53, the separation region 54, and the margin region 55 as candidate regions are each set to have a candidate width equal to the entire width of the corresponding unnecessary region in the conveyance direction, but the width of a region set as a candidate region in the conveyance direction may be equal to the width of part of the corresponding unnecessary region in the conveyance direction.

Figure 11:
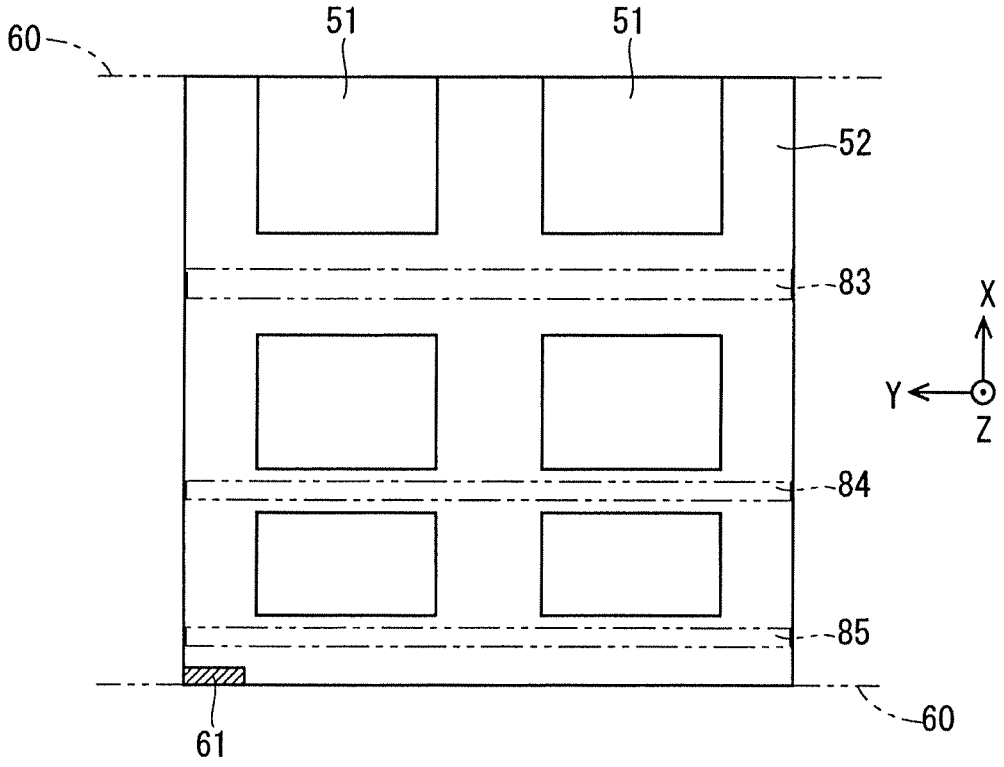
FIG. 11 is a diagram exemplarily illustrating a case in which part of the unnecessary region in a conveyance direction is set as the candidate region according to the preferred embodiment.

FIG. 11 is a diagram exemplarily illustrating a case in which part of an unnecessary region in the conveyance direction is set as a candidate region. As exemplarily illustrated in FIG. 11, a separation region 83, a separation region 84, and a margin region 85 each do not extend over the entire width of the corresponding unnecessary region in the conveyance direction, but are each set to be, for example, only in the vicinity of the center of the unnecessary region in the conveyance direction. In other words, the margin region 85 is disposed separately from the cutting position 60 and each finishing region 51 between which the margin region 85 is sandwiched in the conveyance direction. The separation region 83 and the separation region 84 are each disposed separately from the two finishing regions 51 between which the separation region is sandwiched in the conveyance direction. In FIG. 11, the separation region 83, the separation region 84, and the margin region 85 each extend over part of the corresponding unnecessary region in the conveyance direction, but any of the regions may be a candidate region extending over the entire width of the corresponding unnecessary region in the conveyance direction.

With the above-described setting, in a case of the separation region 83 and the separation region 84, the flushing region can be set in a range not visually recognized (at a folding position, for example) when a product such as a book is produced by combining finishing regions each corresponding to a page.

In a case of the margin region 85, a flushing region can be set in a range avoiding the positioning mark 61.

<Effects of Above-Described Preferred Embodiment>

The following exemplarily describes effects of the above-described preferred embodiment. In the following, the effects will be described based on a specific configuration exemplarily described above in the preferred embodiment, but the configuration may be replaced with any other specific configuration exemplarily described in the specification of the present application as long as the same effects are obtained.

According to the above-described preferred embodiment, the ink jet printing device includes at least one nozzle 22*a* and the control unit 27. The nozzle 22*a* discharges ink droplets onto a recording medium conveyed in the conveyance direction. The recording medium corresponds to, for example, the continuous form paper 100. The control unit 27 controls the flushing operation of the nozzle 22*a*. The cutting positions 60 at which cutting is performed are regularly disposed on the continuous form paper 100. The finishing region 51 in which printing is performed and the unnecessary region 52 other than the finishing regions 51 are disposed on a cut sheet extending between the cutting positions 60 adjacent to each other on the continuous form paper 100. The unnecessary region 52 includes a candidate region used to perform the flushing operation and having a width in the direction orthogonal to the conveyance direction. The candidate region is disposed at a plurality of places separated from each other in the conveyance direction of the cut sheet. The control unit 27 controls the nozzle 22*a* to perform the flushing operation in the candidate regions at the plurality of places in the conveyance direction of the cut sheet.

With this configuration, the flushing operation is performed distributively across the candidate regions at the plurality of places separated from each other in the conveyance direction. Thus, when a sufficient flushing width cannot be obtained with the candidate width of a candidate region at one place, a flushing region can be efficiently allocated by setting a combination of candidate regions at a plurality of places to be the flushing region. Accordingly, restriction on imposition can be reduced. The reduction of restriction on imposition leads to reduction of waste paper.

Any configuration exemplarily described in the specification of the present application other than these configurations may be omitted as appropriate. In other words, the above-described effects can be obtained by having at least these configurations.

However, the above-described effects can be obtained also when at least one of the other configurations exemplarily described in the specification of the present application is added to the above-described configurations as appropriate, in other words, when any other configuration exemplarily described in the specification of the present application but not described as the above-described configurations is added to the above-described configurations.

According to the above-described preferred embodiment, when the flushing width is the width of the flushing region in which the flushing operation is performed on a cut sheet in the conveyance direction, and the candidate width is the width of each candidate region in the conveyance direction, the control unit 27 controls the nozzle 22*a* to perform the flushing operation in candidate regions at a plurality of places, the sum of the candidate widths of which is equal to or larger than the flushing width. With this configuration, candidate regions at a plurality of places are set to be the flushing region so that the sum of the candidate widths of the plurality of candidate regions is equal to or larger than the flushing width necessary for the flushing operation on one cut sheet. In other words, the flushing operation can be performed distributively across a plurality of places in the conveyance direction in a plurality of divided flushing patterns produced by dividing a flushing pattern set to one cut sheet in the conveyance direction. Thus, when a sufficient flushing width cannot be obtained with the candidate width of a candidate region at one place, a flushing region can be efficiently allocated by setting a combination of candidate regions at a plurality of places to be the flushing region.

The total width of a plurality of divided flushing patterns in the conveyance direction (X-axis direction) is equal to the width of a flushing pattern necessary for one cut sheet in the conveyance direction (X-axis direction). Thus, for example, defect in ink discharge from a nozzle can be reliably prevented when flushing is executed a plurality of times in a divided manner as in the present preferred embodiment.

According to the above-described preferred embodiment, the nozzles 22*a* are arranged at a plurality of places in the direction orthogonal to the conveyance direction. The control unit 27 controls the flushing operation by the plurality of nozzles 22*a*. With this configuration, the control unit 27 can control the line flushing operation by the ink-jet head 22 including the plurality of nozzles 22*a*, and hence the line head 30 including an array of a plurality of the ink-jet heads 22.

According to the above-described preferred embodiment, the ink jet printing device includes the priority setting unit 28 to set a priority to each candidate region. The control unit 27 sequentially sets, in descending order of priority, a candidate region to be the flushing region in which the flushing operation is performed. With this configuration, in addition to, for example, a case in which a candidate region positioned further upstream in the conveyance direction is sequentially set to be the flushing region, a priority can be set based on an element such as the area of each candidate region so that a candidate region having a higher priority is sequentially set to be the flushing region. This configuration increases the freedom of setting the flushing region and allows setting of the flushing region in accordance with various usages.

According to the above-described preferred embodiment, candidate regions include the margin region 55 extending between the cutting position 60 and the finishing regions 51 in the conveyance direction, and the separation region 53 and the separation region 54 each extending between the finishing regions 51 adjacent to each other in the conveyance direction. The priority setting unit 28 sets, to the separation region, a priority higher than that of the margin region. With this configuration, overlapping of the flushing region with the positioning mark 61 in the margin region can be effectively avoided by setting the priority of the separation region to be higher than the priority of the margin region.

According to the above-described preferred embodiment, the margin region 85 is disposed separately from at least one of the cutting position 60 and each finishing region 51 between which the margin region 85 is sandwiched in the conveyance direction. With this configuration, the flushing region can be set in a range avoiding the positioning mark 61.

According to the above-described preferred embodiment, the separation region is disposed separately from at least one of the two finishing regions 51 between which the separation region is sandwiched in the conveyance direction. With this configuration, the flushing region can be set in a range not visually recognized when a product such as a book is produced by combining finishing regions each corresponding to a page.

<Modifications of Above-Described Preferred Embodiment>

In the present preferred embodiment, the continuous form paper 100 is described as an exemplary printing medium, but the technology disclosed in the present preferred embodiment is also applicable to any printing medium other than paper, such as a film. The technology is also applicable to any printing medium other than the continuous form paper 100, such as leaflets.

Although the present preferred embodiment exemplarily describes a case in which printing is performed on one of surfaces of a printing medium, in other words, a case in which one-side printing is performed, the technology disclosed in the present preferred embodiment is also applicable to a case in which duplex printing is performed.

Although the present preferred embodiment describes a case in which the line flushing operation is performed by the line head 30, the technology disclosed in the present preferred embodiment is also applicable to a configuration including an ink-jet head configured to perform dispersive flushing.

In the present preferred embodiment, ink jet printing is performed while the continuous form paper 100 is being conveyed relative to the ink-jet head 22. However, ink-jet printing may be performed while the continuous form paper 100 is temporarily stopped or while the ink-jet head 22 is moved relative to leaflets.

The materials, ingredients, dimensions, shapes, relative disposition relation, or conditions of components are described above in the preferred embodiment in some cases, but are merely exemplary in any aspect and not limited to those described in the specification of the present application.

Accordingly, numerous modifications and equivalents that are not exemplarily described are included in the scope of the technology disclosed in the specification of the present application. For example, modification of at least one component includes addition or omission.

Any optional component in the present preferred embodiment may be modified or omitted without departing from the scope of the present invention.

While the invention has been shown and described in detail, the foregoing description is in all aspects illustrative and not restrictive. It is therefore understood that numerous modifications and variations can be devised without departing from the scope of the invention.

What is claimed is:

1. An ink-jet printing device comprising:

at least one nozzle configured to discharge an ink droplet onto a recording medium conveyed in a conveyance direction; and a control unit to control flushing operation of said nozzle, wherein cutting positions at which cutting is performed are regularly disposed on said recording medium, a finishing region in which printing is performed and an unnecessary region other than said finishing region are disposed on a cut sheet extending between said cutting positions adjacent to each other on said recording medium, said unnecessary region includes candidate regions used to perform said flushing operation and having a width in a direction orthogonal to said conveyance direction, said candidate regions are disposed at a plurality of places separated from each other in said conveyance direction of said cut sheet, said control unit comprises:

a flushing pattern setting unit setting a flushing pattern that is a discharge pattern of ink droplets when the flushing operation is performed toward said unnecessary region on each cut sheet; and a flushing region setting unit dividing the flushing pattern that is set by said flushing pattern setting unit into a plurality of divided flushing patterns, and said control unit controls said nozzle to perform said flushing operation in said candidate regions at the plurality of places in said conveyance direction of said cut sheet so that said plurality of divided flushing patterns are printed in said candidate regions at the plurality of places.

2. An ink-jet printing device comprising:

at least one nozzle configured to discharge an ink droplet onto a recording medium conveyed in a conveyance direction; and a control unit to control flushing operation of said nozzle, wherein cutting positions at which cutting is performed are regularly disposed on said recording medium, a finishing region in which printing is performed and an unnecessary region other than said finishing region are disposed on a cut sheet extending between said cutting positions adjacent to each other on said recording medium, said unnecessary region includes candidate regions used to perform said flushing operation and having a width in a direction orthogonal to said conveyance direction, said candidate regions are disposed at a plurality of places separated from each other in said conveyance direction of said cut sheet, and said control unit controls said nozzle to perform said flushing operation in said candidate regions at the plurality of places in said conveyance direction of said cut sheet, wherein a flushing width is defined to be a width of a flushing region in which said flushing operation is performed on said cut sheet, in said conveyance direction, a candidate width is defined to be a width of each candidate region in said conveyance direction, and said control unit controls said nozzle to perform said flushing operation in said candidate regions at a plurality of places, a sum of said candidate widths of which is equal to or larger than said flushing width.

3. The ink-jet printing device according to claim 2, further comprising a priority setting unit to set a priority to each candidate region, wherein said control unit sequentially sets, in descending order of said priority, each candidate region to be a flushing region in which said flushing operation is performed.

4. The ink-jet printing device according to claim 3, wherein said candidate region includes a margin region between each cutting position and said finishing region in said conveyance direction, and a separation region between said finishing regions adjacent to each other in said conveyance direction, and said priority setting unit sets, to said separation region, a priority higher than a priority of said margin region.

5. The ink-jet printing device according to claim 4, wherein said margin region is disposed separately from at least one of said cutting position and said finishing region between which said margin region is sandwiched in said conveyance direction.

6. The ink-jet printing device according to claim 4, wherein said separation region is disposed separately from at least one of said two finishing regions between which said separation region is sandwiched in said conveyance direction.

7. The ink-jet printing device according to claim 2, wherein a plurality of said nozzles are arranged in the direction orthogonal to said conveyance direction, and said control unit controls said flushing operation by the plurality of said nozzles.

8. An ink-jet printing method of controlling flushing operation of at least one nozzle configured to discharge an ink droplet onto a recording medium conveyed in a conveyance direction, the method comprising:

setting a flushing pattern that is a discharge pattern of ink droplets when flushing operation is performed toward said unnecessary region on each cut sheet when cutting positions at which cutting is performed are regularly disposed on said recording medium, a finishing region in which printing is performed and an unnecessary region other than said finishing region are disposed on a cut sheet extending between said cutting positions adjacent to each other on said recording medium, said unnecessary region includes a candidate region used to perform said flushing operation and having a width in a direction orthogonal to said conveyance direction, and said candidate regions are disposed at a plurality of places separated from each other in said conveyance direction of said cut sheet;

dividing a flushing pattern that is set into a plurality of divided flushing patterns; and controlling said nozzle to perform said flushing operation in said candidate regions at a plurality of places in said conveyance direction of said cut sheet so that said plurality of divided flushing patterns are printed in said candidate regions at the plurality of places.

9. An ink-jet printing method using at least one nozzle configured to discharge ink toward a recording medium conveyed in a conveyance direction in accordance with printing data, the method comprising:

setting a flushing pattern for said cut sheet, when cutting positions at which cutting is performed are regularly disposed on said recording medium, and a cut sheet extending between cutting positions adjacent to each other is defined on said recording medium;

specifying a flushing width as a length of said set flushing pattern in said conveyance direction;

extracting, by referring to said printing data, a plurality of candidate regions in which flushing is to be executed on said cut sheet;

specifying a candidate width as a length of each extracted candidate region in said conveyance direction;

dividing, by referring to said flushing width and said plurality of candidate widths, said flushing pattern to produce divided flushing patterns each having a length equal to or smaller than said candidate widths of said plurality of candidate regions in said conveyance direction;

adding data for printing said plurality of divided flushing patterns to said printing data so that said divided flushing patterns are printed in said corresponding candidate regions; and executing said flushing operation while executing printing based on said printing data to which the data for printing said divided flushing patterns is added by discharging said ink from said nozzle toward said recording medium being conveyed in said conveyance direction in accordance with said printing data.

* * * * *